US006595179B1

(12) United States Patent
Kanno

(10) Patent No.: US 6,595,179 B1
(45) Date of Patent: Jul. 22, 2003

(54) ELECTRICAL CONTROL FOR ENGINE

(75) Inventor: Isao Kanno, Shizuoka (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 09/511,942

(22) Filed: Feb. 24, 2000

(30) Foreign Application Priority Data

Feb. 24, 1999 (JP) ..... 11-046618

(51) Int. Cl.[7] ..... F02D 41/22
(52) U.S. Cl. ..... 123/198 D; 123/478; 123/630
(58) Field of Search ..... 123/478, 479, 123/490, 41.15, 198 D, 630; 701/103

(56) References Cited

U.S. PATENT DOCUMENTS

| | | | | |
|---|---|---|---|---|
| 3,053,243 A | | 9/1962 | Domann | |
| 3,229,792 A | | 1/1966 | Hock | |
| 3,414,734 A | | 12/1968 | Konrad | |
| 3,657,720 A | | 4/1972 | Avdenko et al. | |
| 3,712,283 A | | 1/1973 | Kiess et al. | |
| 4,373,619 A | * | 2/1983 | Schritt et al. | 192/0.09 |
| 4,898,132 A | | 2/1990 | Kanno | |
| 4,898,192 A | | 2/1990 | Kanno | |
| 4,917,061 A | | 4/1990 | Nagakura | |
| 4,941,854 A | | 7/1990 | Takahashi et al. | |
| 4,949,684 A | | 8/1990 | Gohara | |
| 5,069,174 A | | 12/1991 | Kanno | |
| 5,272,386 A | * | 12/1993 | Kephart | 307/116 |
| 5,548,273 A | * | 8/1996 | Nicol et al. | 340/439 |
| 5,563,452 A | * | 10/1996 | Kephart | 307/10.1 |
| 5,687,694 A | * | 11/1997 | Kanno | 123/478 |
| 5,873,322 A | | 2/1999 | Koyanagi | |
| 5,988,130 A | | 11/1999 | Nakamura | |
| 6,024,068 A | | 2/2000 | Nakase et al. | |
| 6,196,208 B1 | * | 3/2001 | Masters | 123/597 |

FOREIGN PATENT DOCUMENTS

| | | |
|---|---|---|
| CH | 576 071 | 5/1976 |
| JP | 62-128836 | 6/1987 |

* cited by examiner

*Primary Examiner*—Henry C. Yuen
*Assistant Examiner*—Jason Benton
(74) *Attorney, Agent, or Firm*—Knobbe, Martens, Olson & Bear LLP

(57) ABSTRACT

An electrical control system for an engine includes a power supply system that supplies electric power to an engine control unit. The system has a power source connected to the engine control unit via a locking relay. The relay includes an exciting coil that is energized by electrical power when a main switch is closed. The control unit comprises a tacho-pulse shaping circuit or a fuel pump drive circuit that outputs a signal that prolongs the energized state of the coil after the main switch is opened. The signal prolongs the energized state of the coil for a preset time.

42 Claims, 8 Drawing Sheets

ELECTRICAL CONTROL FOR ENGINE

PRIORITY INFORMATION

This application is based on and claims priority to Japanese Patent Application No. 11-046,618, filed Feb. 24, 1998, the entire contents of which is hereby expressly incorporated by reference.

BACKGROUND OF THE INVENTION

1. Field of the Invention

The present invention generally relates to an electrical system for an engine. More particularly, the present invention relates to an improved electrical system that comprises a control unit and a power supply circuit that is connected to the control unit through a time delay switch.

2. Description of Related Art

Recently, engine designers have been emphasizing decreasing emissions, improving fuel economy and, at the same time, maintaining if not improving power output. One way of obtaining at least some of these results involves electrically controlling any of a variety of engine operations. For instance, ignition timing can be altered to better reflect changing engine operating parameters. Moreover, certain characteristics of fuel injected engines can be optimized through an electrically controlled fuel injection system.

An engine control unit (ECU) typically forms a portion of such an electrical control of the engine. For instance, an outboard engine can comprise a number of sensors that sense engine running conditions, ambient conditions or other conditions of the outboard motor that could affect ultimate engine performance. The engine generally includes controllable engine actuators such as, for example, fuel injectors and spark plugs. Signals from the sensors are received by the ECU and the ECU controls the engine actuators in response to the sensed signals. In arrangements in which the engine actuators are the fuel injector and spark plug, for instance, an injection timing, a duration of injection and a firing timing can be controlled and manipulated by the ECU. Thus, the ECU often forms an integral component in an efficiently designed and operated engine. Malfunctions with the ECU, therefore, can impair engine operation.

With reference now to FIG. 1, an exemplary circuit diagram of a prior power supply system is illustrated. It is believed that at least some portions of the illustrated circuit have been used in earlier outboard motor designs. As illustrated, a first portion of the power supply system is located within the watercraft hull while a second portion of the power supply system is located within the outboard motor. The first portion and the second portion can be joined through suitable couplings.

A battery 20 can be provided in the hull of the associated watercraft. In addition, an ECU 22 can be mounted on an engine used in the outboard motor. In the illustrated arrangement, a set of engine actuators, that can include a fuel injector 24, an ignition coil 26 and a fuel pump 28, are connected to the ECU 22. The illustrated power supply system 30 further includes a main switch 32 and a stop switch 34 that is linked with the main switch 32. These switches can be disposed within the hull of the watercraft. A locking relay 36 can be disposed on the outboard motor and a wire harness 38 can extend between and couple a variety of components.

The negative pole of the illustrated battery 20 is grounded and the positive pole thereof is connected directly to the ECU 22 and to the actuators 24, 26, 28 via the relay 36. Preferably, the relay 36 is normally open. The relay 36 generally comprises an excitable coil 44 that holds the contacts 40 in a closed position when supplied with electrical power. One end of the coil 44 can be grounded and the other end can be connected to a relay control terminal 46 of the ECU 22. The positive pole of the battery 20 is also connected to a relay-state detection terminal 48 of the ECU 22 via the main switch 32.

One end of the stop switch 34 can be grounded, while the other end thereof is connected to the ECU 22. The stop switch 34 is normally closed and can be opened when the main switch 32 is closed because the switch 34 is linked to the main switch 32.

When the main switch 32 is closed, the exciting coil 44 is powered through the ECU 22 and the contacts 40 of the relay 36 are closed. Simultaneously, the ECU 22 holds the contacts 40 in this/closed position through a supply of electricity. The engine actuators 24, 26, 28 are, therefore, supplied with power. When the main switch 32 is opened, the stop switch 34 is closed and the ECU 22 stops supplying power to the coil 44. The ECU 22 continues operating for a preset time after the stop switch 34 is closed and then the ECU 22 shuts down.

Because the exciting coil 44 of the relay 36 is controlled by the ECU 22 in the illustrated power supply system 30, the ECU 22 must furnish a separate control circuit for the relay use only. The provision of the seperate control circuit necessarily increases the size and associated cost of the ECU 22. In addition, the ECU 22 is coupled with the sensors and engine actuators through a connector that has multiple terminals. Connectors sold on the market are available for this purpose. However, because such connectors have a fixed number of terminals, for example, twenty four or thirty two terminals, if even one or more terminals, is needed, a special connector must be used. This increases the cost of the ECU 22 and occasionally requires a larger connector size. In this regard, the conventional power supply system 30 needs at least two additional terminals. i.e., the relay control terminal 46 and the relay detective terminal 48, for the activation and deactivation of the relay 36.

SUMMARY OF THE INVENTION

A need therefore exists for an improved engine electrical control system that can decrease the required size and cost of the associated ECU.

Accordingly, one aspect of the present invention involve a control system for an internal combustion engine comprising a power source and a control unit controlling an operation of the engine. A coupling switch selectively joins the power source and the control unit. A main switch is provided between the power source and the coupling switch with the main switch being adapted to switch the coupling switch between a coupling condition and a non-coupling condition. The coupling switch is brought to the coupling condition when the main switch is closed. The coupling switch includes an actuator that is coupled to the power source through the main switch with the actuator being adapted to move and maintain the coupling switch in the coupling condition when activated. A delay component is coupled to the actuator with the delay component selectively activating the actuator after the main switch is opened.

Another aspect of the present invention involves a method of controlling a power supply to a controller adapted to control an engine. The method comprising sensing an operational condition of a main switch, generating an output signal when said operational condition of said main switch changes for a preset period of time, and delaying a shutdown of said controller when said output signal ends.

A further aspect of the present invention involves an electrical control system for an internal combustion engine comprising a control unit controlling an operation of the engine and a power source. Coupling means are provided for coupling together the control unit and the power source under a coupling condition. A switch is provided for switching the coupling means between the coupling condition and a non-coupling condition. The coupling means are brought to the coupling condition when the switch is turned on and the coupling means include a self-hold element that holds the coupling means under the coupling condition when activated by electric power supplied through the switch. The control system further comprises preservation means that are provided for preserving the self-hold element under an active condition when the switch is turned off.

For purposes of summarizing the invention and the advantages achieved over the prior art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein. Moreover, further aspects, features and advantages of this invention will become apparent from the detailed description of the preferred embodiments which follow.

BRIEF DESCRIPTION OF THE DRAWINGS

As discussed above.

DETAILED DESCRIPTION OF THE PREFERRED EMBODIMENTS OF THE INVENTION

Figure 1:
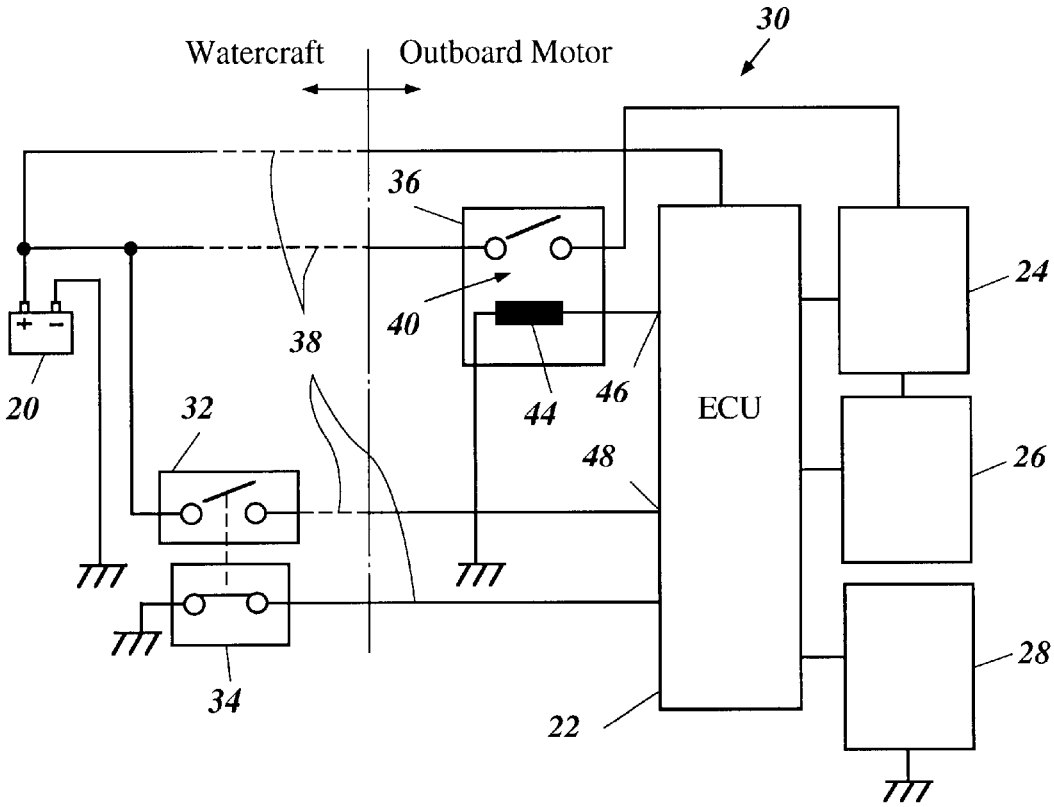
Figure 1 Prior Art
FIG. 1 is a prior circuit diagram illustrating an example of a conventional power supply system such that the present invention can be better understood and appreciated. The above-noted and other features, aspects and advantages of the present invention will now be described with reference to the drawings of a preferred embodiment, which embodiment is intended to illustrate and not to limit the invention, and in which figures.

With reference now to FIGS. 2 to 5, an outboard motor, designated generally by the reference numeral 60, includes an internal combustion engine 62 which has a power supply system 64 arranged in accordance with certain features, aspects and advantages of the present invention. Although the present invention is shown in the context of an engine for an outboard motor, various aspects, features and advantages of the present invention also can be employed with other engines such as, for example, watercraft, all terrain vehicles, automobile and motorcycle engines.

In the illustrated embodiment, the outboard motor 60 comprises a drive unit 66 and a bracket assembly 68. Although schematically shown in FIGS. 2 and 3, the bracket assembly 68 actually comprises a swivel bracket and a clamping bracket. The swivel bracket supports the drive unit 66 for pivotal movement about a generally vertically extending steering axis. The clamping bracket, in turn, is affixed to a transom 70 of an associated watercraft 74 and supports the swivel bracket for pivotal movement about a generally horizontally extending axis. A hydraulic tilt system can be provided between the swivel bracket and the clamping bracket to tilt the drive unit 66 up or down. If this tilt system is not provided, the operator can otherwise tilt the drive unit 66 in any known manner. Since the construction of the bracket assembly 68 is well known in the art, further description is not believed to be necessary.

As used throughout this description, the terms "forward," "front" and "fore" mean at or to the side where the bracket assembly 68 is located, and the terms "rear," "reverse" and "rearwardly" mean at or to the opposite side of the front side, unless indicated otherwise.

Figure 2:
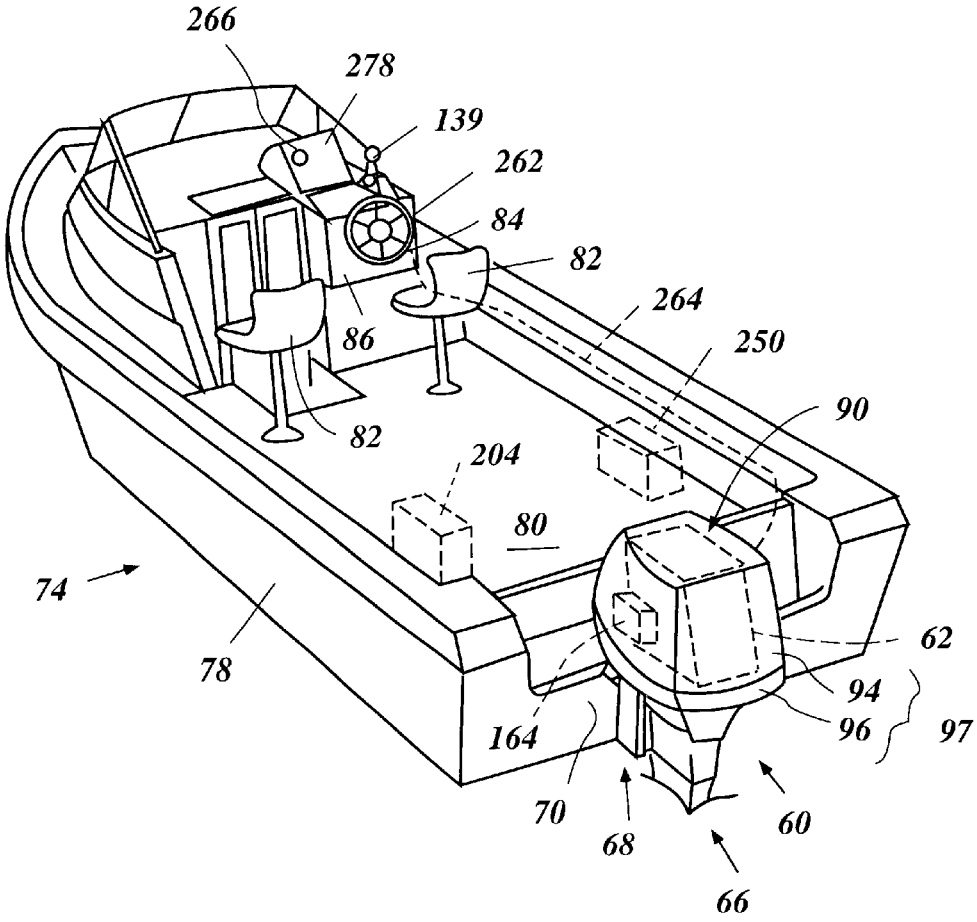
FIG. 2 is a perspective view of a watercraft propelled by an outboard motor that is configured and arranged in accordance with certain features, aspects and advantages of the present invention.

As seen in FIG. 2, the illustrated watercraft 74 is a power boat, but can comprise any of a number of other types of watercraft. The watercraft 74 generally comprises a hull 78 that defines a deck 80. At least one seat 82, and preferably more than one seat, is disposed in the most forward area of the deck 80. In the illustrated arrangement, one of the seats is provided for the operator and is positioned near a steering wheel 84 that is rotatably mounted on a control panel 86. The steering wheel 84 can be coupled to the bracket assembly 68 of the outboard motor 60 so that the operator can remotely steer the motor 60 left and right.

The drive unit 66 will now be described in detail. The drive unit 66 generally includes a power head 90, a driveshaft housing 92 and a lower unit 94. The power head 90 forms an uppermost portion of the illustrated drive unit 66 and desirably includes the engine 62, a top protective cowling 94 and a bottom protective cowling 96. Together, the cowlings 94, 96 define a cowling assembly 97.

The engine 62 preferably operates on a four stroke combustion principle and powers a propulsion device. As seen in the upper view of FIG. 3 and FIGS. 4 and 5, the engine 62 comprises a cylinder body 98. In the illustrated engine, the cylinder body 98 defines four cylinder bores 100 extending in a generally horizontal direction. The bores 100 are generally vertically spaced relative to one another. That is, the engine 62 is a L4 (in-line 4 cylinder) type. An associated piston 102 preferably reciprocates in each cylinder bore 100.

A cylinder head assembly 104 is affixed to one end of the illustrated cylinder body 98. Thus, four combustion chambers 108 are defined by the pistons 102, the cylinder bores 98 and the cylinder head assembly 104. The other end of the cylinder body 98 is closed with a crankcase member 110 that defines a crankcase chamber with the cylinder bores 100. A crankshaft 112 extends generally vertically through the crankcase chamber. The crankshaft 112 is connected to the pistons 102 with connecting rods 114 in a known manner. Thus, the crankshaft 112 rotates with the reciprocal movement of the pistons 102. The crankcase member 110 preferably is located at the most forward position of the power head 90, and the cylinder body 98 and the cylinder head assembly 104 extend rearwardly from the crankcase member 110 one after the other.

The engine 62 includes an air induction system 114 and an exhaust system 116. The air induction system 114 is arranged to supply air charges to the combustion chambers 108 and comprises a plenum chamber member 118 that defines a plenum chamber 120 therein, The induction system 114 also comprises four main intake passages 122 and four intake ports. The intake ports are defined in the cylinder head assembly 104 and can be opened or closed by intake valves 124. When the intake ports are opened, the air intake passages 122 communicate with the combustion chambers 108.

The plenum chamber member 118 is positioned on the port side of the crankcase member 110. The plenum chamber member 118 has an inlet opening (not shown) that opens to the interior of the cowling assembly 97 at its front side. The plenum chamber 120 fuctions as an intake silencer and/or a coordinator of air charges. The air intake passages 122 extend rearwardly from the plenum chamber 122 along the cylinder body 98 and then curve toward the intake ports. The respective intake passages 122 are vertically spaced apart from one another. The air intake passages 122 actually are defined by duct sections 126, throttle bodies 128 and runners 130. The duct sections 126 preferably are unified with the plenum chamber member 118. The upper, two throttle bodies 128 can be unified with one another. The upper, two runners 186 also can be unified with one another other at their fore portions and then forked into two rear portions. Desirably, the lower, two throttle bodies 128 and the associated runners 130 have the same constructions as the upper, two throttle bodies 128 and runners 130, respectively.

The respective throttle bodies 128 support throttle valves 132 (see FIG. 3) therein for pivotal movement about axes of valve shafts extending in a generally vertical direction. The valve shafts are linked together to form a single valve shaft assembly 134 that passes through the entire throttle body 128. Desirably, the throttle valves 132 can be controlled by the operator through a throttle cable 136 and an associated non-linear control mechanism 138. The throttle cable 136 also can be connected to a throttle/shift lever 139 that is positioned aside of the control panel 86.

The non-linear control mechanism 138 preferably includes a first lever 142 and a second lever 144 joined together with each other by a cam connection. The first lever 142 is pivotally connected to the throttle cable 136 and also to a first pin 146, which is affixed to the cylinder body 98. The first lever 142 includes a cam hole 148 at the end opposite of its connection with the throttle cable 136. The second lever 144 generally is shaped as the letter "L" and is pivotally connected to a second pin 150, which is affixed to the crankcase member 110. The second lever 144 has a pin 152 that interfits the cam hole 148. The other end of the second lever 144 is pivotally connected to a control rod 156. The control rod 156, in turn, is pivotally connected to a lever member 158 (see FIG. 5). The lever member 158 is connected to the throttle valve shaft assembly 134 via a torsion spring 160 that urges the control rod 156 to the position shown in FIG. 4. At this position of the control rod 156, the throttle valve 132 is in a closed position wherein almost no air charge can pass through the air intake passages 122.

Figure 4:
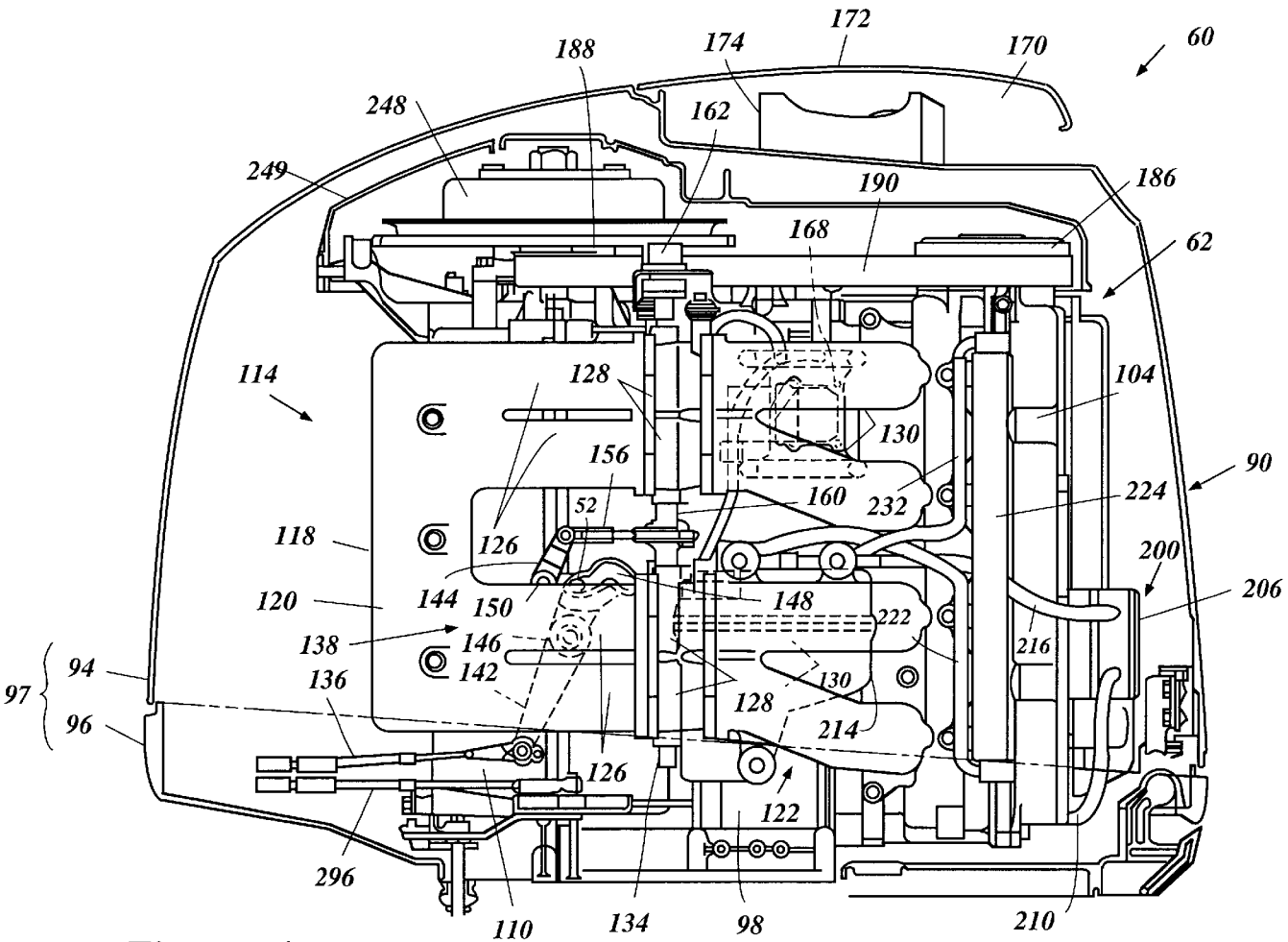
FIG. 4 is a partially sectioned elevational side view of the outboard motor.

When the throttle cable 136 is operated by the throttle/shift lever 139, the first lever 142 preferably pivots about the first pin 146 in a counter-clockwise direction, as shown in FIG. 4. The second lever 144, then, preferably pivots about the second pin 150 in a clockwise. Because the pin 152 of the second lever 144 is interfitted in the cam hole 148, the second lever 144 desirably moves along this cam shape. The second lever 144 can push the control rod 156 against the biasing force of the torsion spring 160 to open the throttle valves 132. When the throttle cable 136 is released, the control rod 156 can return to the initial position by the biasing force of the spring 160 and the throttle valves 132 can be closed again.

A throttle valve position sensor 162 can be positioned proximate the throttle valve shaft assembly 134. A signal from the position sensor 162 is sent to an ECU 164 through a signal line 166 for various engine controls including an idle speed control and fuel injection control that will be described later. Of course, the signal can be sent through transmission cables or can be transmitted in non-cabled manners. The signal from this throttle valve position sensor 162 can represents the engine load and/or the throttle opening. The ECU 164 can be mounted on the left side of the engine 62.

Figure 3:
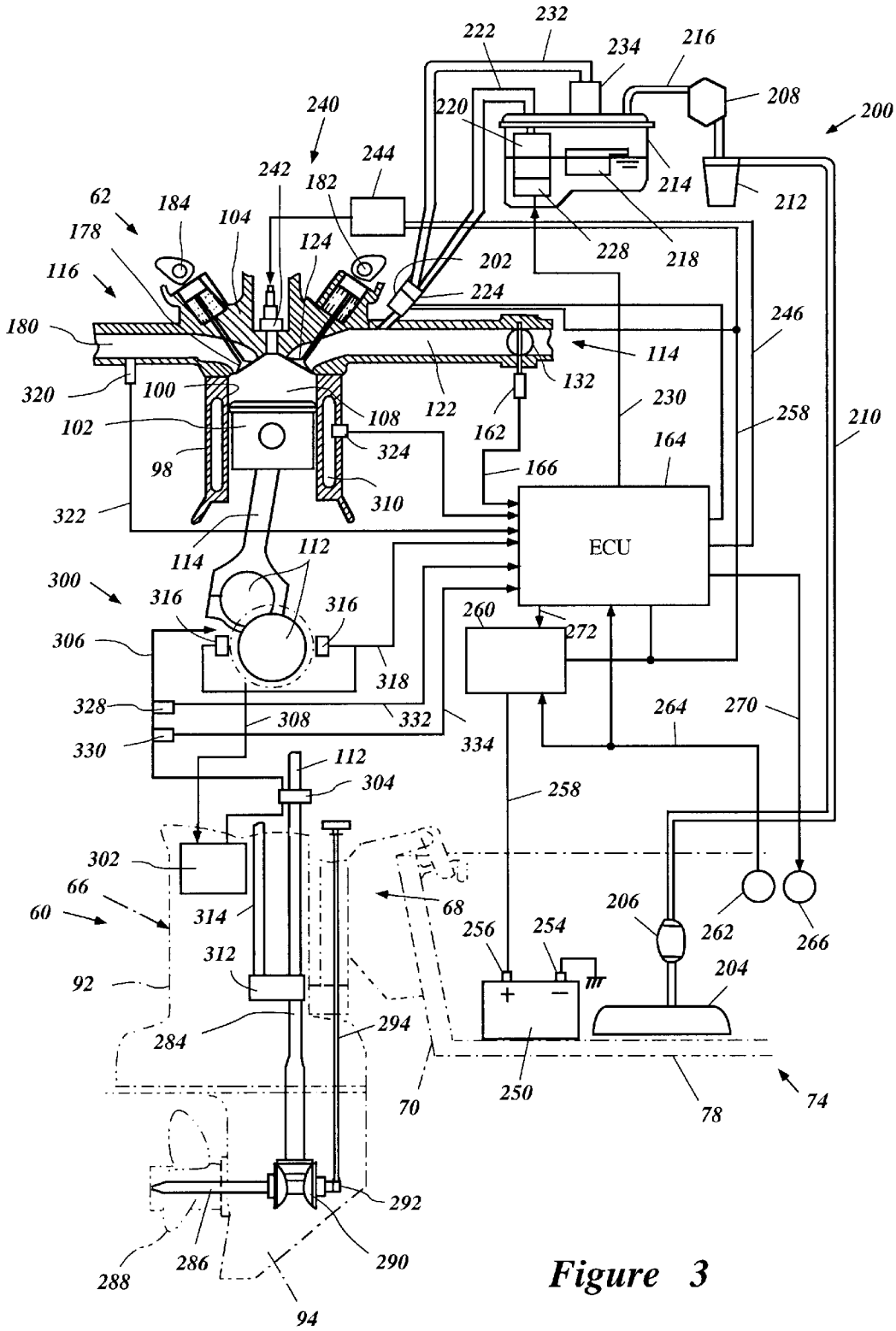
FIG. 3 is a schematic view of the outboard motor with a portion of the engine and an ECU being shown generally in the upper half view and a portion of the outboard motor and the watercraft being shown in the lower half view and with the outboard motor and the associated watercraft being illustrated in phantom.

The air induction system 114 further includes a bypass passage or idle air supply passage that bypasses the throttle valves 132, although it is omitted in FIG. 3. An idle air adjusting unit 168, which comprises a control valve positioned therein, can be provided in the bypass passage. Preferably, the idle air adjusting unit 168 is located between the cylinder body 98 and the main air intake passages 122 and is affixed to the upper, two runners 130. An opening of the valve in the idle air adjusting unit 168 also can be controlled by the ECU 164.

The cowling assembly 97 generally completely encloses the engine 62. The top cowling 94 is detachably affixed to the bottom cowling 96 so that the operator can access the engine 62 for maintenance or other purposes. As seen in FIG. 4, the top cowling 94 preferably has air intake compartments 170 defined between the top surface of the top cowling 94 and the cover members 172. Each air intake compartment 170 has an air inlet duct 174 that couples the space in the compartment 170 and the interior of the cowling assembly 97.

Air is introduced, at first, into the air intake compartments 170 and enters the interior of the cowling assembly 97 through the air inlet ducts 174. Then, the air travels to the inlet opening of the plenum chamber member 118 and enters the plenum chamber 120. When the engine is operating above idle, an air charge amount is controlled by the throttle valves 132 to meet the requirements of the engine 62. The air charge, then, goes to the runners 130 and reaches the intake ports. As described above, the intake valves 132 are provided at these intake ports. When the intake valves 124 are opened, the air is supplied to the combustion chambers 108 as an air charge. Under the idle running condition, the throttle valves 132 are generally closed. The air, therefore, goes to the idle air adjusting unit 168 that is controlled by the ECU 164. The idle air charge controlled by the adjusting unit 168 is supplied to the combustion chambers 108 via the intake passages 122.

The exhaust system 116 is arranged to discharge burnt charges or exhaust gasses outside of the outboard motor 60 from the combustion chambers 108. Exhaust ports are defined in the cylinder head assembly 104 and opened or closed by a set of corresponding exhaust valves 178. When the exhaust ports 86 are opened, the combustion chambers 108 communicate with a single or multiple exhaust passages 180 that lead the exhaust gasses downstream in the exhaust system 116.

An intake camshaft 182 and an exhaust camshaft 184 extend generally vertically and are used to actuate the intake valves 124 and exhaust valves 178, respectively. These camshafts 182, 184 have cam lobes that push the valves 124, 178 at certain times to open or close the respective ports. The camshafts 182, 184 are journaled on the cylinder head assembly 104 and driven by the crankshaft 112. The respective camshafts 182, 184 have sprockets 186 atop of them, while the crankshaft 112 also has a sprocket 188. A timing belt or chain 190 is wound around the sprockets 186, 188. With rotation of the crankshaft 112, therefore, the camshafts 182, 184 rotate also. As is known, the crankshaft generally rotates twice for every single rotation of the camshafts 182, 184.

The engine 62 also includes a fuel supply system 200. Preferably, the fuel supply system 200 includes fuel injectors. Of course, in some arrangement, the fuel can be supplied through carburetors or other structures. In addition, the engine can use direct or indirect injection depending upon the application. The illustrated fuel injection system 200 includes four fuel injectors 202, which have injection nozzles exposed to the intake ports so that injected fuel is directed into the combustion chambers 108. A main fuel supply tank 204 preferably is placed in the hull 78 of the associated watercraft 74. Although any place on the deck 80 is available, in the illustrated embodiment, the fuel tank 204 is positioned at the rear left side of the deck 80.

Fuel is drawn from the fuel tank 204 by a first low pressure fuel pump 206 and a second low pressure pump 208 through a first fuel supply conduit 210. The first low pressure pump 206 is a manually operated pump. The second low pressure pump 206 is a diaphragm type operated by one of the intake and exhaust camshafts 182, 184. In the illustrated embodiment, the second pump 206 is mounted on the cylinder head assembly 104. Of course, other suitable fuel pumps also can be used. A quick disconnect coupling (not shown) is provided in the first conduit 210 and a fuel filter 212 also is positioned in the conduit 210 at an appropriate location.

From the low pressure pump 208, the fuel is supplied to a vapor separator or a fuel reservoir 214 through a second fuel supply conduit 216. In the illustrated embodiment, the vapor separator 214 is affixed proximate the lower, two runners 186. At the vapor separator end of the conduit 216, there is provided a float valve (not shown) that is operated by a float 218 so as to maintain a uniform level of the fuel within the vapor separator 214.

A high pressure fuel pump 220 can be provided in the vapor separator 124. This pump 220 can pressurize the fuel that is to be delivered to the fuel injectors 202 through a delivery conduit 222. As illustrated, the fuel injectors 202 preferably are supported by a fuel rail 224 and this fuel rail 137 can form at least a portion of the delivery conduit 222. The high pressure fuel pump 220 can be driven by an electric motor 228 that is unified with the pump 220 at its bottom portion. Preferably, the electric motor 228 is controlled by the ECU 164 via a signal line 230.

A fuel return conduit 232 also can be provided between the fuel injector 202 and the vapor separator 214. The excess fuel that is not injected by the injector 202 returns to the vapor separator 214 through this conduit 232. A pressure regulator 234 is mounted on the vapor separator 214 at the end of the return conduit 232 to limit the pressure that is delivered to the fuel injectors 202.

A preset amount of fuel preferably is sprayed into the intake ports through the injection nozzles of the fuel injectors 202. Because the fuel pressure is regulated by the pressure regulator 234, a duration for which the nozzle of the injectors 202 are opened is one factor that can be controlled by the ECU 164 such that a preset amount of fuel can be injected by the injectors 202. The duration and the injection timing, thus, can be controlled, either independently or together, by the ECU 164 through a signal line 236. Of course, as with any of the signal lines disclosed and discussed herein, the signal line 236 can be replaced by other forms of signal transmission constructions, such as infrared radiation or electromagnetic wave forms, for instance.

The engine 62 further includes a firing system 240. In the illustrated arrangement, four spark plugs 242 are affixed on the cylinder head assembly 104 and are exposed into the respective combustion chambers 108. The spark plugs 242 fire an air/fuel charge at a certain firing timing under control of the illustrated ECU 164 to burn the air/fuel charge. For this purpose, the firing system 240 has an ignition coil 244 interposed between the spark plugs 242 and the ECU 164 that are connected together with a signal line 246. The air/fuel charge is formed with an air charge supplied by the main air intake passages 122 and with a fuel charge sprayed by the fuel injectors 202.

Figure 5:
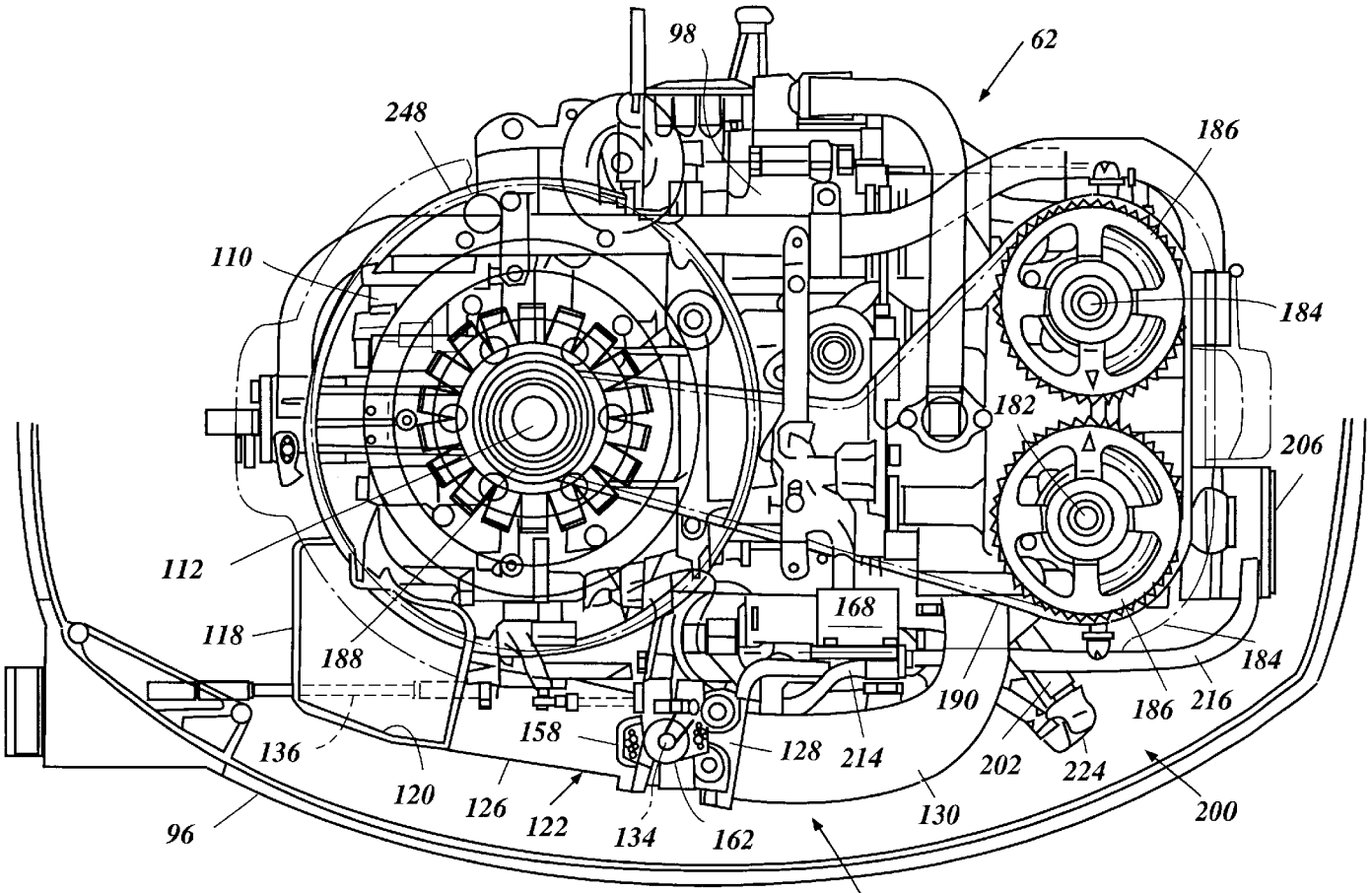
FIG. 5 is a top plan view showing a portion of the outboard motor of FIG. 4.

With reference to FIGS. 4 and 5, a flywheel assembly 248 preferably is affixed atop of the crankshaft 112. A cover member 249 covers the flywheel assembly 248, the sprockets 186, 188 and the belt 190. The flywheel assembly 248 includes an AC generator that generates electric power. The generated AC power is delivered to a battery 250, which is included in the power supply system 64, through a rectifier that rectifies the AC power to DC power. The battery 250 preferably accumulates power and also selectively supplies it to electrical equipment including the ECU 164, fuel injectors 202 and ignition coil 244.

The negative pole 254 of the battery 250 is grounded, while the positive pole 256 is coupled to the ECU 164, the fuel injectors 202 and the ignition coil 244 through a power supply line 258 via a locking relay 260 which is a kind of electrical coupler or switch. Of course, the relay 260 can comprise any number of electrical components designed to secure a switch in a preset position when power is supplied to the ECU. As will become evident, the locking relay may be replaced by other types of electrical coupling devices. For instance, a photo coupler also can be used. Preferably, a main switch 262 is provided to activate the locking relay 260 and the ECU 164 through an activation line 264. In the illustrated embodiment, a tachometer 266 also is provided and the ECU 164 controls it through a tachometer control line 270. In addition, the ECU 164 can maintain the locking relay 260 in the closed position through a hold line 272 for a preset period of time as will be described shortly.

While not illustrated, the engine 62 also can include a recoil starter that drives the flywheel to start the engine 62. A starter motor can be used in addition to or in the alternative to the recoil starter. The use of a starter motor is preferred when the present invention is employed with larger engines. For instance, the starter motor can be activated when the main switch 262 is turned on by the operator.

As seen in FIG. 2, the battery 250 can be located in the hull 78 of the associated watercraft 74. Like the fuel tank 204, although the battery 250 may be placed at any position on the deck 80, in the illustrated embodiment, it is positioned at the rear right side on the deck 80. The illustrated main switch 262 is placed on the control panel 86 at the right-hand side of the steering wheel 84. The tachometer 266 can be positioned in a display 278 disposed in the control panel 86.

As seen in the lower half view of FIG. 3, the driveshaft housing 92 depends from the power head 90 and supports a driveshaft 284, which is driven by the crankshaft 112 of the engine 62. The driveshaft 284 preferably extends generally vertically through the driveshaft housing 92. The driveshaft housing 92 also defines several internal passages which can form portions of the exhaust system 116.

The lower unit 94 depends from the driveshaft housing 92 and preferably supports a propeller shaft 286 that is driven by the driveshaft 284. The propeller shaft 286 extends generally horizontally through the illustrated lower unit 48. In the illustrated arrangement, the propulsion device includes a propeller 288 that is drivingly connected to an outer end of the propeller shaft 286. A transmission 290 can be provided between the driveshaft 284 and the propeller shaft 286. The illustrated transmission 290 couples together the two shafts 284, 286 which lie generally normal to each other (i.e., at a 90° shaft angle) with a bevel gear combination.

A shift mechanism is provided to shift rotational directions of the propeller 288 between forward, neutral and reverse. The shift mechanism preferably includes a shift cam 292, a shift rod 294 and shift cable 296 (see FIG. 4). The shift rod 294 extends generally vertically through the driveshaft housing 66 and the lower unit 94, while the shift cable 296 extends outwardly from the lower cowling 96 and is connected to the throttle/shift lever 139 that is operated by the operator when he or she wants to shift the transmission.

The lower unit 94 also defines an internal passage that forms a discharge section of the exhaust system 116. When the engine is operating above idle, the majority of the exhaust gasses are discharged to the body of water surrounding the outboard motor 60 through the internal passage and finally through a hub of the propeller 288.

The engine 62 also has a lubrication system 300, which is schematically shown in FIG. 3, for lubricating certain portions of the engine 62 such as, for example, the pivotal joints between the connecting rod 114 and the crankshaft 112 and the connecting rod 114 and the piston 102. A lubricant reservoir 302 is disposed at a proper location in the driveshaft housing 92. Lubricant in the reservoir 302 is drawn from the reservoir 302 by an oil pump 304 that is disposed between the crankshaft 112 and the driveshaft 284 so as to be driven by the shafts 112, 284. Of course, the pump can be driven by either shaft or can be otherwise driven by electricity or the like. The lubricant is delivered to the portions which need lubrication through a lubricant supply line 306. The lubricant returns to the lubricant reservoir 302 through a lubricant return line 308 in a known manner. Thus, the lubrication system generally comprises a closed loop.

In addition, the outboard motor 60 has a cooling system for cooling certain portions of the engine 62, such as the cylinder body 98 and the cylinder head assembly 104. In the illustrated embodiment, a water jacket 310 is shown in FIG. 3 as provided in the cylinder block 98. A water pump 312 is provided for supplying cooling water to such water jackets including the jacket 310. The water pump 312 preferably is driven by the driveshaft 284. Although not shown, a water inlet is provided in the lower unit 94 to introduce cooling water from the body of water surrounding the motor 60. The water is supplied to the water jackets through a water supply conduit 314.

As noted above, the illustrated ECU 164 can control various engine operations, including the fuel injection from the injectors 202 and the firing of the spark plugs 242, with various control maps stored in the ECU 164. In order to determine appropriate control indexes from the maps that are stored in the ECU 164, various sensors monitor engine running conditions, ambient conditions or other conditions of the outboard motor 60 that could affect ultimate engine performance. For instance, in the illustrated arrangement, a crankshaft angle position sensor 316 outputs a crankshaft rotational speed signal or engine speed signal, indicated schematically at 318, to the ECU 164. The crankshaft position sensors 316 define a pulse generator, in other words. The engine speed signal or pulses 318 will be used not only for the engine control by the ECU 164 but also for shaping tacho-pulses to drive the tachometer 266. The tacho-pulses will be described in detail shortly.

A combustion condition or oxygen ($O_2$) sensor 320 preferably detects the in-cylinder combustion conditions by sensing the residual amount of oxygen in the combustion products at a time near the time when the exhaust port is opened. This output and the air fuel ratio signal is indicted schematically at 322 to the ECU 164.

A water temperature sensor 324, which outputs a cooling water temperature signal, indicated schematically at 326, to the ECU 164, is provided at the water jacket 310.

Also, there are provided an oil temperature sensor 328 and an oil pressure sensor 330 which output an oil temperature signal and an oil pressure signal, indicated schematically at 332 and 334, to the ECU 164, respectively.

The sensed conditions are merely some of those conditions which may be sensed for engine control and it is, of course, practicable to provide other sensors such as, but without limitation, an intake air pressure sensor, an intake air temperature sensor, an engine height sensor, a trim angle sensor, a knock sensor, a neutral sensor, a watercraft pitch sensor, a shift position sensor and an atmospheric temperature sensor in accordance with various control strategies.

Figure 6:
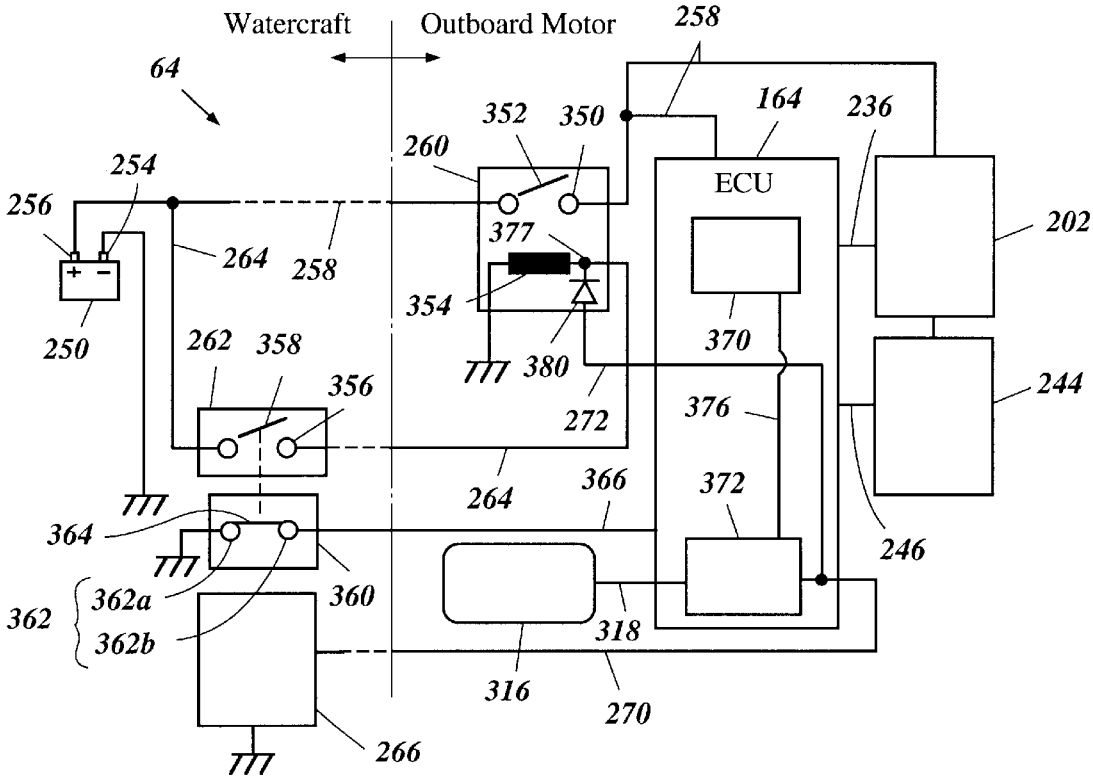
FIG. 6 is a schematic diagram of a power supply system that is configured and arranged in accordance with certain features, aspects and advantages of the present invention.

FIG. 6 illustrates the power supply system 64 that will now be described in detail. The illustrated locking relay 260 comprises a fixed contact 350 and a movable contact 352. These contacts 350, 352 preferably are normally open but can be closed and grounded in some applications. When the movable contact 352 abuts on the illustrated fixed contact 350, the power supply line 258 is closed to supply electrical power from the battery 250 to the ECU 164 and to the engine actuators, which can include the fuel injectors 202 and the ignition coil 244. As used herein, the term "engine actuators" refers to actuators that control the engine 62. Engine actuators other than the fuel injectors and the spark plugs also can be controlled by the ECU and powered through the present arrangement. For instance, solenoids and throttle valves can be controlled by the ECU in some applications.

The illustrated locking relay 260 also comprises an excitable coil 354 which is positioned proximate the contacts 350, 352. One end of the coil 354 preferably is grounded while the other end preferably is connected to the main switch 262 through the activation line 264. When the main switch 262 is closed (i.e., turned ON in the illustrated arrangement), and hence the coil 354 is energized, the movable contact 352 is moved toward the fixed contact 350 by electromagnetic force. Thus, the power supply line 258 is closed under the influence of the coil. Under this condition, the ECU 164 and the engine actuators 202, 244 are activated or supplied with power.

The illustrated main switch 262 also comprises a fixed contact 356 and a movable contact 358. The contacts 356, 358 preferably are normally opened but can be normally closed and grounded in some applications. When the movable contact 358 abuts on the fixed contact 356, the power supply line 258 is closed. As mentioned above, the "closed" condition is considered the "turned on" condition of the main switch 262 and thus the coil 354 of the relay 260 is activated when the main switch 262 is closed.

In the illustrated arrangement, a stop switch 360 is linked with the main switch 262. The illustrated stop switch 360 has a fixed contact 362, which comprises a first part 362*a* and a second part 362*b*, and a movable contact 364. The first part 362*a* preferably is grounded, while the second part 362*b* preferably is connected to the ECU 164 through an deactivation line 366. The contacts 362, 364 desirably are normally closed, but can be otherwise configured, such as normally opened to ground, for instance. When the main switch 262 is closed, the stop switch 360 is opened. Conversely, when the main switch 262 is opened, the stop switch 360 is closed and the ECU 164 is deactivated because it is grounded through the deactivation line 366.

In the illustrated arrangement, the ECU 164 includes a locking circuit 370 and a tacho-pulse shaping circuit 372. The locking circuit 370 powers up the ECU 164 when an electric current passes therethrough and maintains the ECU in the powered up state until after the stop switch 360 is closed. The locking circuit 370 can be formed with a monostable multivibrator in some arrangements. Of course, other constructions of the locking circuit can also be used. Moreover, the locking circuit can be employed either through hardware or software implementations.

Figure 7:
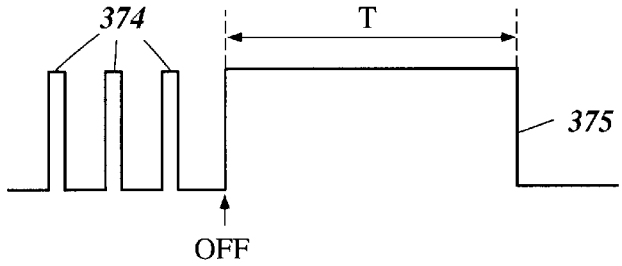
FIG. 7 is a waveform diagram illustrating an output of a tacho-pulse shaping circuit.

The tacho-pulse shaping circuit 372 preferably is provided between the crankshaft angle position sensors 316 and the tachometer 266, and advantageously shapes the tacho-pulses 374. For instance, the output from the circuit 372 can be similar to that shown in FIG. 7 in arrangements in which the circuit output is at least partially based upon engine speed signals or pulses 318 output from the crankshaft angle position sensors 316. The pulses 374 can be supplied to the tachometer 266 through the tachometer control line 270 to indicate the engine speed to the operator.

When the main switch 262 is turned off (i.e., the stop switch 360 is closed), the locking circuit 370 preferably forces the tacho-pulse shaping circuit 372 to a present output level (for example, 12V) 375, which also is based upon the pulses 374 for a preset period of time T. In the illustrated arrangement, the output goes to a relatively high level and is substantially maintained at that relatively high level for a preset period of time. Of course, other types of signals also can be used. The output control at least partially corresponds to a signal indicated schematically at 376 that is provided by tacho-pulse shaping circuit 372 to the locking circuit 370. In some arrangements, the tacho-pulse shaping circuit 372 can be formed with a multivibrator with a reset timer.

The output of the tacho-pulse shaping circuit 372 preferably is connected by the hold line 272 to a junction point 377 that is positioned between the exciting coil 354 and the main switch 262. A diode 380 can be positioned in this line 378 with its negative pole directed toward the point 377. The diode limits the current flowing through the line 378 in a known manner.

Thus, even after the main switch 262 is turned off, the illustrated locking circuit 370 maintains the coil 354 in the energized state for the preset period of time T by the hold signal or high level output 375 of the tacho-pulse shaping circuit 372. The hold line 272, including the diode 380, also can maintain the energization of the coil 354 even if the main switch 262 is erroneously or unintentionally turned off by such as, for example, breaking down or inferior condition of the contacts 362, 364 of the main switch 360.

From the foregoing description, those of ordinary skill in the art will readily appreciate that a number of components described herein as being hard wired also can be implemented through various software and other types of circuitry and controllers. In addition, the illustrated ECU can be formed with a one-chip or multiple-chip IC or LSI and the locking circuit, tacho-pulse shaping circuit and a pump control circuit (described below) can be formed separately from other electrical elements within the ECU or can be formed with the ECU. In addition, the preset timer function is not necessarily a portion of the locking circuit. The operator manually interrupt the excitation of the coil, in some arrangements. For instance, a normally closed switch can be added to the hold line 272 and the operator can open the normally closed contacts after a certain elapsed period, such as, ten seconds, for example.

Figure 8:
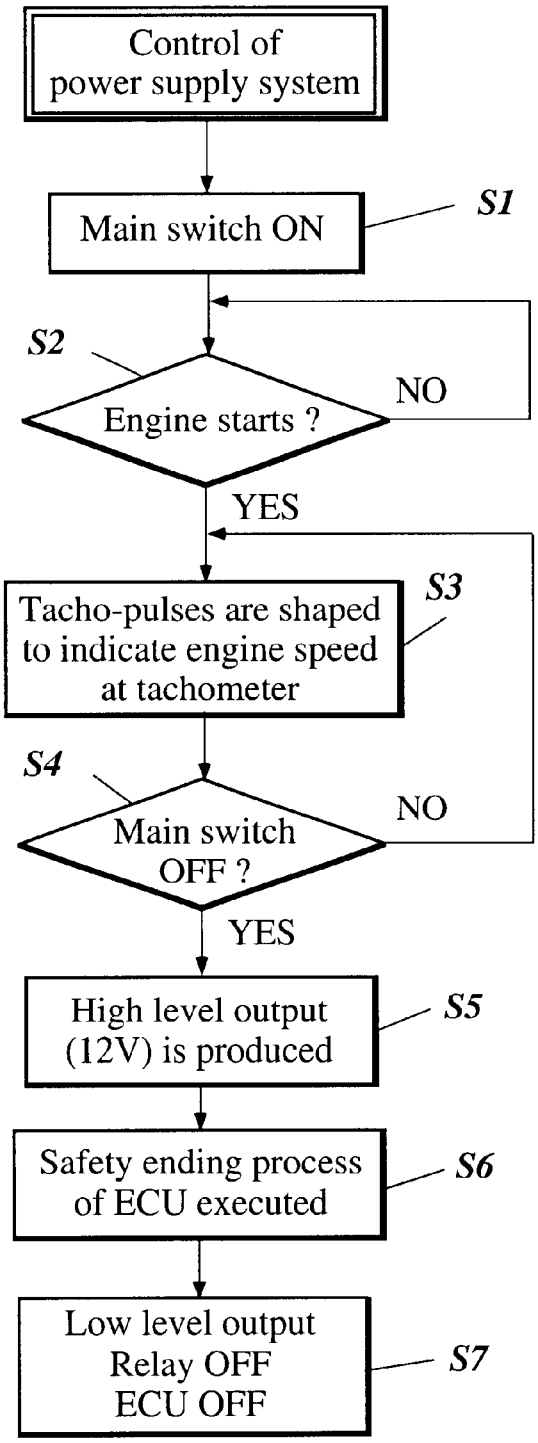
FIG. 8 is a flow diagram illustrating an exemplary control routine that can be used in a power supply system and that employs certain features, aspects and advantages of the present invention.

With reference now to FIG. 8, a sequence of events that can occur within a presently preferred control of the power supply system 64 will be described. In this arrangement, when the main switch 262 is turned on (see step S1), the coil 354 of the locking relay 260 is excited which brings the movable contact 352 into contact with the fixed contact 350. That is, the contacts 350, 352 are closed and electric power is supplied from the battery 250 to the ECU 164 and the engine actuators 202, 244 through the line 258. The engine actuators 202, 244 are also controlled by the ECU 164 through the lines 236, 246. At or about the same time, the stop switch 360 is opened position by corresponding movement of the main switch 262. In addition, the locking circuit 370 energizes the ECU 164 and maintains the power supply to the ECU unless certain of the following steps are executed.

The starter motor can be used to start the engine 62 when the main switch 262 turned on. The ECU 164 then determine whether the engine 62 has started by monitoring the engine speed (see step S2). If the engine 62 has started, the signal or pulses 318 are shaped by the tacho-pulse shaping circuit 372 as tacho-pulses 374 that can be used to indicate the engine speed by the tachometer 266 (see step S3). The tacho-pulses 374 also are transmitted to the coil 354 via the tacho-pulse shaping circuit 372 and the diode 380 to maintain its powered up state, as noted above. If the ECU 164 determines that the engine 62 has not started, the program simply continues to monitor the engine speed.

The ECU 164 then determines whether the main switch 262 is turned off by checking to see if the stop switch 364 is closed, for instance (see step S4). If the main switch 262 is still in the on position the ECU continues to monitor the position of the main switch 262. If, on the other hard the main switch 262 has been turned off, the tacho-pulse shaping circuit 372 produces the high level output 375 based upon the engine speed signal or pulses 318 for a preset period of time T (see step S5). Because of this, the coil 354 will be energized for the additional period T to hold the contacts 350, 352 in the closed position. The ECU 164 and the engine actuators 202, 244 are, therefore, continuously powered by the battery 250 for the time T also.

After the tacho-pulse shaping circuit 372 starts outputting the high level output 375 during the time period T, the ECU 164 carries out a shut down sequence that safely deactivates the ECU I64(see step S6). At the end of the preset time T, the control routine deenergizes the coil 354 (see step S7). Accordingly, the contacts 350, 352 are opened and power is removed from the ECU 164 and the actuators 202, 244.

As described above, in the illustrated arrangement, the coil 354 is moved into the energizing state as soon as the main switch 262 is moved into an "ON" position. Thus, special terminals, such as a relay control terminal and a relay detective terminal that have been provided in earlier designs are not necessary. In addition, while the crankshaft angle position sensors 316 are provided primarily for producing the engine speed signal or pulses 319 that is used at the tachometer 266, the circuit 372 also maintains the energized state of the coil 354 after the main switch 262 is turned off. The ECU 164, therefore, can be simplified by using the locking circuit 370 and the tacho-pulse shaping circuit 372. Thus, the cost for the ECU 164 can be reduced and also the ECU 164 in the embodiment provides a compact configuration. Of course, in some arrangements, the locking circuit 370 can be used with a different timing circuit and, in other arrangements, the tacho-pulse shaping circuit can be used with other types of controls.

Figure 9:
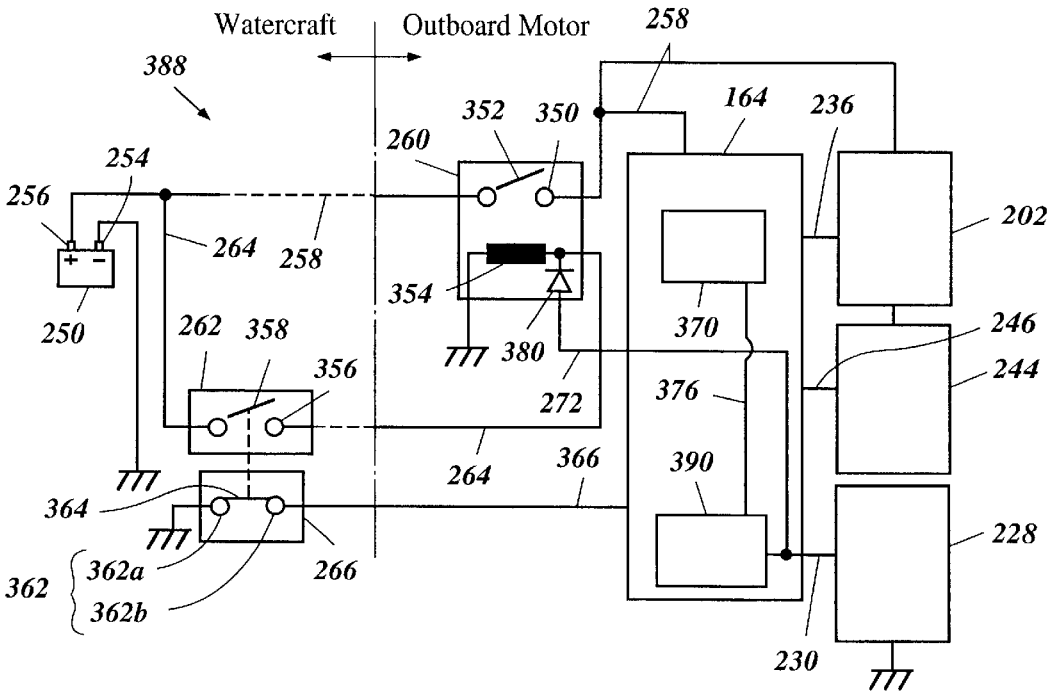
FIG. 9 is a schematic diagram of another power supply system having certain features, aspects and advantages in accordance with the present invention.

FIG. 9 illustrates another power supply system 388 that is configured and arranged in accordance with certain features, aspects and advantages of the present invention. The same elements, units and wiring that have been already described will not be described unless necessary for a proper understanding of the illustrated arrangement.

In the illustrated arrangement, a fuel pump control circuit 390 is provided in the ECU 164. The pump control circuit 390 is provided not only for controlling the fuel pump 228 but also for forming a high level output, similar to that of the tacho-pulse shaping circuit. That is, the pump control circuit 390 makes pulses that are similar to the pulses 374 under the engine running conditions and then makes the high level output that is similar to the high level output 375 shown in FIG. 7. The high level output is, like the output 375, sustained for a preset time so that the coil 354 maintains its locked condition for the preset time, such that the contacts 350, 352 are held in a closed condition. The fuel pump 228 also continues its pumping operation for the preset time in the illustrated arrangement. After the time period has elapsed, the contacts 350, 352 can be opened and power can be removed from the ECU 164 and the fuel pump 228 as well as from most other engine actuators 202, 224. In some arrangements, a separate pump drive circuit can be provided between the ECU 164 and the fuel pump 228.

Similar to the crankshaft angle position sensors 316, the fuel pump control circuit 390 primarily drives the fuel pump 228. The ECU 164, therefore, does not need any additional control elements except for the locking circuit 370. The pump control circuit 390 can be slightly modified such that the circuit can generate the high level output. The same advantages as those described in the context of the arrangement described above, therefore, can be obtained in this arrangement.

As will be recognized, the signal that stops energizing the exciting coil is not necessarily related to the engine component control signal. Other signals such as for example, a shift control signal, can be applied. Moreover, the state of the coil can be controlled by components other than the main switch 262. For instance, the action of the starter motor or even the recoil starter can be used to energize the coil.

Although the present invention has been described in terms of certain embodiments, other embodiments apparent to those of ordinary skill in the art also are within the scope of this invention. Thus, various changes and modifications may be made without departing from the spirit and scope of the invention. For instance, various components may be repositioned or replace by known equivalents as desired. Moreover, not all of the features, aspects and advantages are necessarily required to practice the present invention. Accordingly, the scope of the present invention is intended to be defined only by the claims that follow.

What is claimed is:

1. A control system for an internal combustion engine comprising a power source, a control unit controlling an operation of said engine, a coupling switch selectively joining said power source and said control unit, a main switch operating between said power source and said coupling, switch, said main switch switching said coupling switch between a coupling condition and a non-coupling condition, said coupling switch being brought to said coupling condition when said main switch is closed, said coupling switch including an actuator that is coupled to said power source through said main switch, said actuator maintaining said coupling switch in said coupling condition when activated, and a delay component that is coupled to said actuator, said delay component activating said actuator after said main switch is opened.

2. A control system as set forth in claim 1, wherein said delay component energizes said actuator for a preset time period after main switch is opened.

3. A control system as set forth in claim 1, wherein said delay component energizes said actuator by employing a signal that is primarily used for a component that relates to a control of said engine.

4. A control system as set forth in claim 3, wherein said engine includes a sensor sensing an operational condition of said engine, and said signal employed by said delay component comprises a signal sensed by said sensor.

5. A control device as set forth in claim 4, wherein said sensor senses an engine speed.

6. A control system as set forth in claim 3, wherein said engine includes a fuel injection system having a fuel pump, and said component comprises said fuel pump.

7. A control system as set forth in claim 1, wherein said delay component produces a hold signal that energizes said actuator for a preset period of time after said main switch is opened.

8. A control system as set forth in claim 1, wherein said delay component comprises said locking circuit that energizes said control unit when said main switch is opened.

9. A control system as set forth in claim 1, wherein said coupling switch comprises a relay having a fixed contact and a movable contact, and actuator comprises an exciting coil that is adapted to exert a magnetic force on said movable contact to move said moveable contact into contact with said fixed contact.

10. A control system as set forth in claim 9, wherein said exciting coil comprises a pair of ends, one of said pair of ends is grounded and said other of said pair of ends is connected to said power source through said main switch.

11. A control system as set forth in claim 1, wherein said main switch comprises a fixed contact and a movable contact, and said actuator is activated when said movable contact comes into contact with said fixed contact.

12. A control system as set forth in claim 1, wherein said power source comprises a battery.

13. A control system as set forth in claim 1, wherein said actuator is integrally formed with said control unit.

14. A control system as set forth in claim 1, wherein said actuator is an electrically operated component.

15. A control system as set forth in claim 14, wherein said actuator generates a magnetic force.

16. A control system as set forth in claim 15, wherein said actuator in a coil through which current is passed.

17. A method of controlling a power supply to a controller of an engine, said method comprising determining when a main switch of said controller is deactivated, generating an output signal for a preset of time when said main switch deactivated so as to continue powering said controller, and discontinuing power to said controller when said output signal ends.

18. The method of claim 17, wherein said output signal is generated by a sensor used to detect an operational condition of said engine.

19. The method of claim 18, wherein said sensor is an engine speed sensor.

20. The method of claim 17, wherein said output signal is generated by a control circuit for a component of said engine.

21. The method of claim 20, wherein said component is a fuel pump.

22. A method of controlling a power supply to a controller adapted to control an engine, said method comprising sensing an operational condition of a main switch, generating an output signal for a preset period of time when said operational condition of said main switch changes, delaying a shutdown of said controller until said output signal ends, and supplying power to said controller through an electrically activated switch.

23. The method of claim 22 further comprising closing said electrically activated switch when said main switch is closed.

24. The method of claim 23 further comprising opening said electrically activated switch after said preset period of time elapses.

25. An electrical control system for an internal combustion engine comprising a control unit controlling an operation of the engine, a power source, coupling means for coupling together the control unit and the power source under a coupling condition, a switch for switching the coupling means between the coupling condition and a non-coupling condition, the coupling means being brought to the coupling condition when the switch is turned on, the coupling means including a self-hold element that holds the coupling means under the coupling condition when activated by electric power supplied through the switch, the control system further comprising preservation means for preserving the self-hold element under an active condition when the switch is turned off.

26. An electrical control system as set forth in claim 25, wherein the preservation means preserves the self-hold element under the active condition for a preset time period after the switch is turned off.

27. An electrical control system as set forth in claim 25, wherein the preservation means preserves the self-hold element under the active condition by employing a signal that is primarily used for a component that relates to a control of the engine.

28. An electrical control system as set forth in claim 27, wherein the engine includes a sensor sensing an operational condition of the engine, and the signal employed by the preservation means includes a signal sensed by the sensor.

29. An electrical control device as set forth in claim 28, wherein the sensor senses an engine speed.

30. An electrical control system as set forth in claim 29, wherein the engine includes a fuel injection system having a fuel pump, and the component includes the fuel pump.

31. An electrical control system as set forth in claim 25, wherein the preservation means produces a preservation signal that preserves the self-hold element under the active condition for a preset period of time after the switch is turned off.

32. An electrical control system as set forth in claim 25, wherein the preservation means includes a self-hold circuit disposed in the control unit, and the self-hold circuit holds the control unit itself under an active condition when the switch is turned off.

33. An electrical control system as set forth in claim 25, wherein the coupling means includes a relay having a fixed contact and a movable contact, and the self-hold element has an exciting coil that makes the movable contact come into contact with the fixed contact when excited.

34. An electrical control system as set forth in claim 33, wherein the exciting coil has a pair of ends, one of the ends is grounded and the other end is connected to the power source through the switch.

35. An electrical control system as set forth in claim 25, wherein the switch includes a fixed contact and a movable contact, and the self-hold element is activated when the movable contact comes into contact with the fixed contact.

36. An electrical control system as set forth in claim 25, wherein the power source includes a battery.

37. An electrical control system as set forth in claim 25, wherein the engine is employed for powering a marine propulsion device.

38. A power supply system comprising a control device configured to control an engine, a power source, a first switch movable between first and second positions, the first switch connecting the control device with the power source when the first switch is in the first position, an actuator maintaining the first switch in the first position when the actuator is activated, a second switch movable between third and fourth positions, the second switch initially connecting the actuator with the power source to activate the actuator when the second switch is in the third position, the control device holding the actuator in the activated state with a continual signal that is primarily supplied to a component related to the operation of the engine.

39. The power supply system as set forth in claim 38 additionally comprising a third switch movable between fifth and sixth positions, the third switch disabling the control device when the third switch is in the sixth position, the control device delaying the disablement thereof for a preset period of time after the third switch is brought into the sixth position from the fifth position.

40. The power supply system as set forth in claim 39, wherein the second and third switches are linked together, the third switch is in the fifth position when the second switch is in the third position, and the third switch is in the sixth position when the second switch is in the fourth position.

41. A method for controlling power supply to a control device of an engine, comprising supplying power to the control device, starting the engine by the control device, and maintaining the power supply to the control device by a continual signal that is primarily supplied to a component related to the operation of the engine.

42. The method as set forth in claim 41 additionally comprising shutting down the control device, and delaying the shutdown of the control device for a preset period of time.

* * * * *

UNITED STATES PATENT AND TRADEMARK OFFICE

CERTIFICATE OF CORRECTION

PATENT NO. : 6,595,179 B1
DATED : July 22, 2003
INVENTOR(S) : Isao Kanno

It is certified that error appears in the above-identified patent and that said Letters Patent is hereby corrected as shown below:

Title page,
Item [56], References Cited, U.S. PATENT DOCUMENTS, please add -- 5,144,300 A 09/1992 Kanno --

Column 1,
Line 6, please change "1998" to -- 1999 --

Signed and Sealed this

Seventeenth Day of February, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,595,179 B1
DATED : July 22, 2003
INVENTOR(S) : Isao Kanno

It is certified that error appears in the above-identified patent and that said Letters Patent is hereby corrected as shown below:

Column 14,
Line 13, change “main switch” to -- said main switch --

Column 15,
Line 8, change “of” to -- for --
Line 11, change “preset of time” to -- preset period of time --

Signed and Sealed this

Fifth Day of October, 2004

JON W. DUDAS
*Director of the United States Patent and Trademark Office*